United States Patent [19]

Dutch et al.

[11] Patent Number: 4,623,128

[45] Date of Patent: Nov. 18, 1986

[54] FENCING AND LIKE STRUCTURES

[75] Inventors: Geoffrey C. Dutch, Fennell Bay; Trevor K. Dutch, Narrabri, both of Australia

[73] Assignee: Costanza Pty. Limited, New South Wales, Australia

[21] Appl. No.: 674,155

[22] PCT Filed: Mar. 8, 1984

[86] PCT No.: PCT/AU84/00037

§ 371 Date: Nov. 8, 1984

§ 102(e) Date: Nov. 8, 1984

[87] PCT Pub. No.: WO84/03532

PCT Pub. Date: Sep. 13, 1984

[30] Foreign Application Priority Data

Mar. 8, 1983 [AU] Australia ..... PF8336

[51] Int. Cl.[4] ..... E04H 17/14

[52] U.S. Cl. ..... 256/65; 256/24; 256/73

[58] Field of Search ..... 256/65, 66, 67, 24, 256/19, 73; 403/187, 399

[56] References Cited

U.S. PATENT DOCUMENTS

| | | | |
|---|---|---|---|
| 3,195,864 | 7/1965 | Case | 256/65 |
| 3,770,245 | 11/1973 | Murdock | 256/65 X |
| 3,942,763 | 3/1976 | Helterbrand et al. | 256/65 X |
| 4,014,520 | 3/1977 | Walters | 256/65 X |
| 4,279,529 | 7/1981 | Lande et al. | 256/65 X |
| 4,369,953 | 1/1983 | Greiner et al. | 256/65 X |

*Primary Examiner*—Cornelius J. Husar
*Assistant Examiner*—Joseph A. Fischetti
*Attorney, Agent, or Firm*—Oblon, Fisher, Spivak, McClelland & Maier

[57] ABSTRACT

A fencing structure having at least a pair of upright posts each having vertically extending channels that face one another. Extending between each pair of posts are an inverted channel top rail and a bottom rail. The top rail has inwardly directed webs which define an inwardly directed panel receiving throat as has the bottom rail when assembled. A rectangular panel is secured to the top rail and bottom rail by brackets which are locked in the channel, to inwardly directed webs of the top rail and to the bottom rail.

12 Claims, 8 Drawing Figures

10
11
13a
14
15
16
17
18
19
20
40
42
43
44
45
46
47
52
53
54

FENCING AND LIKE STRUCTURES

FIELD OF INVENTION

This invention relates to fencing and like structures such as ballustrades.

For the sake of brevity the invention will be described in relation to a fencing structure but it is to be understood that the invention is not limited thereto as it may be applied to ballustrades, divider walls, partitions, gates, security enclosures and diverse other structures of a panel nature. The term "fencing structure" as used herein embraces all such uses and applications of the invention.

BACKGROUND ART

Known types of fencing structures are indeed many and varied. For example, in the specialised field of swimming pool safety fencing there are many different kinds of fencing available. In the main, however, they tend to have the appearance of mesh and as such are not particularly attractive.

It is an object of this invention to provide a light weight fencing structure which may be readily assembled from standard components to provide an attractive yet functional fencing structure.

DISCLOSURE OF THE INVENTION

According to the invention there is provided a fencing structure comprising:

(i) a pair of spaced apart upright post members each having vertically extending channel means with the channel means of each post facing one another, (ii) a top rail of inverted channel form extending between the post members and having inwardly directed webs defining a panel-receiving throat that extends along the rail, (iii) bottom rail means extending between the post members and having a panel-receiving throat that extends along the bottom rail means, (iv) a rectangular panel extending between, and secured to the top rail and the bottom rail means with the top edge of the panel in the throat of the top rail and its bottom edge in the throat of the bottom rail means, and, (v) means for securing the ends of the top rail to the respective post members, said securing means including:

(a) a bracket having a first flange located in the channel means of the post member and a second flange located in the end of the rail, (b) means for fixing the first flange to the post member, and, (c) means for securing the second flange to the inwardly directed webs of the rail.

BRIEF DESCRIPTION OF THE DRAWINGS

In order that the invention may be more readily understood and put into practical effect, reference will now be made to the accompanying drawings in which.

DESCRIPTION OF PREFERRED EMBODIMENTS

Figure 1:
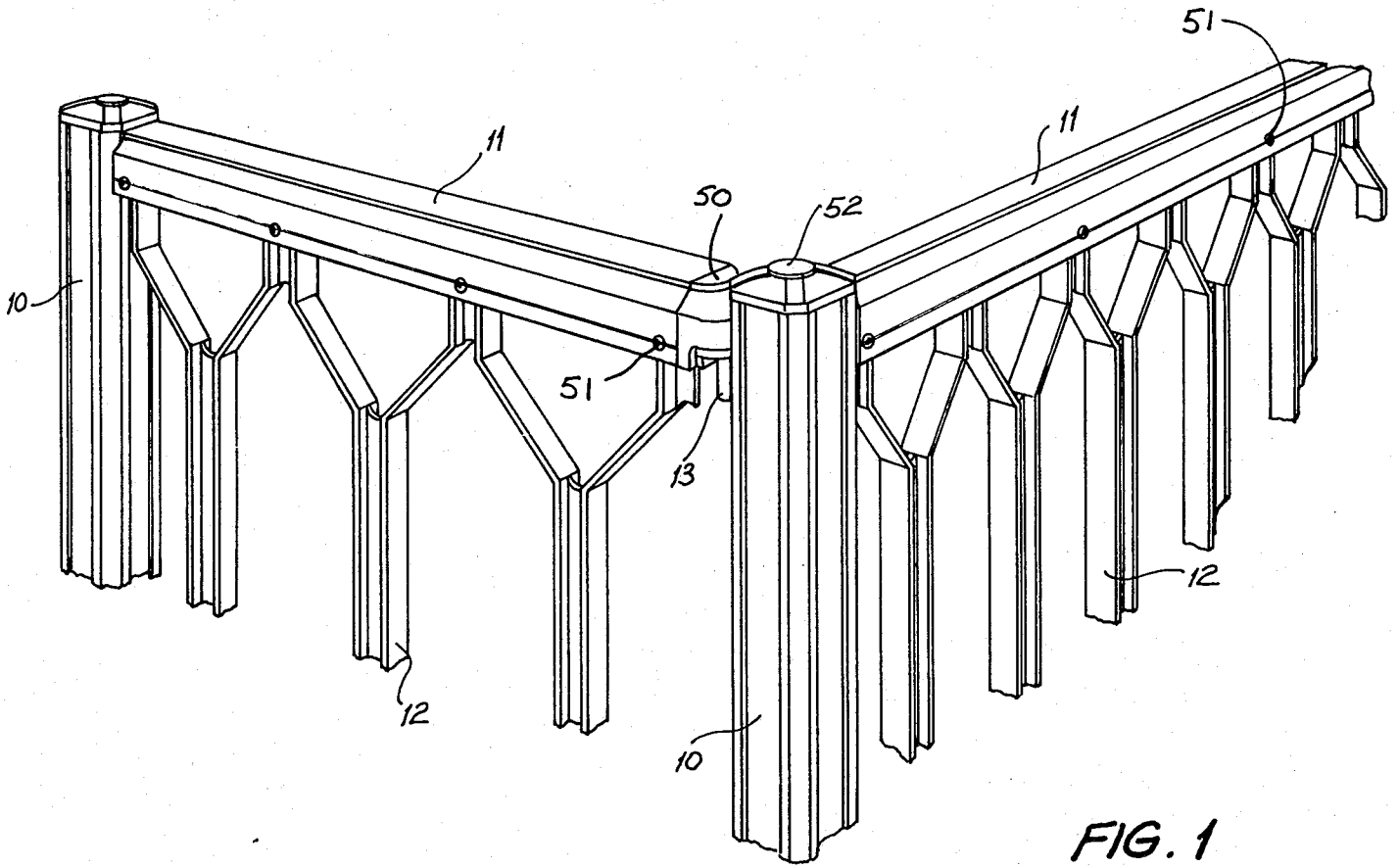
FIG. 1 is a partially cut away, perspective view of a fencing structure according to one embodiment of the invention.
Figures 2, 3:
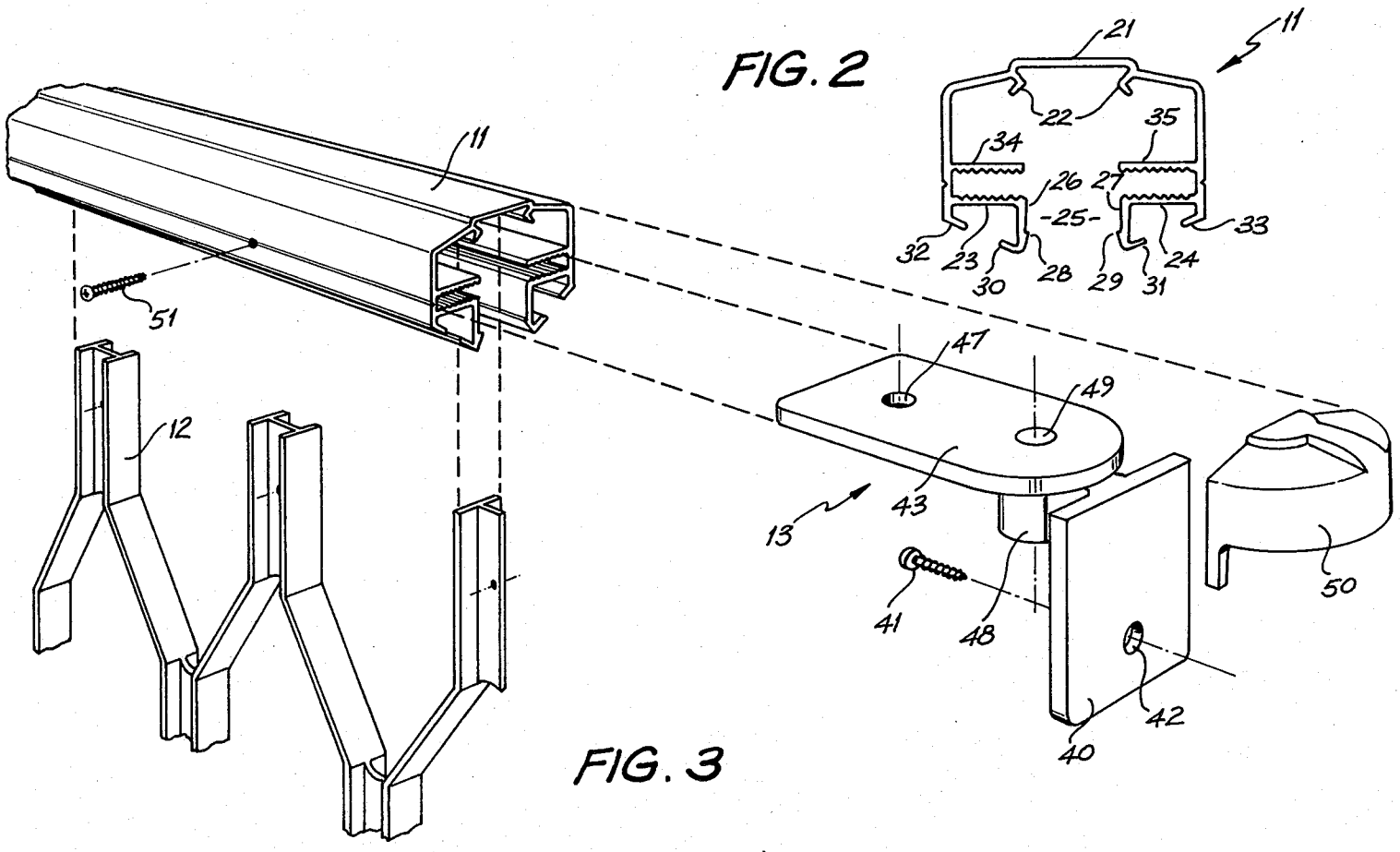
FIG. 2 is a cross-sectional view of the top rail of the fencing structure shown in FIG. 1.
FIG. 3 is an exploded view showing the means for securing the top rail to the post member.

The two panel fencing structure partly shown in FIG. 1 and the single panel fencing structure shown in FIG. 2 includes a post member 10, a top rail 11, an open-work panel 12 and securing brackets 13. The top rail 11 extends between post 10 and another similar post 10 and the panel 12 extends between the top rail 11 and a somewhat similar but inverted bottom rail means 60 shown in FIGS. 7 and 8.

Figures 4, 5, 6:
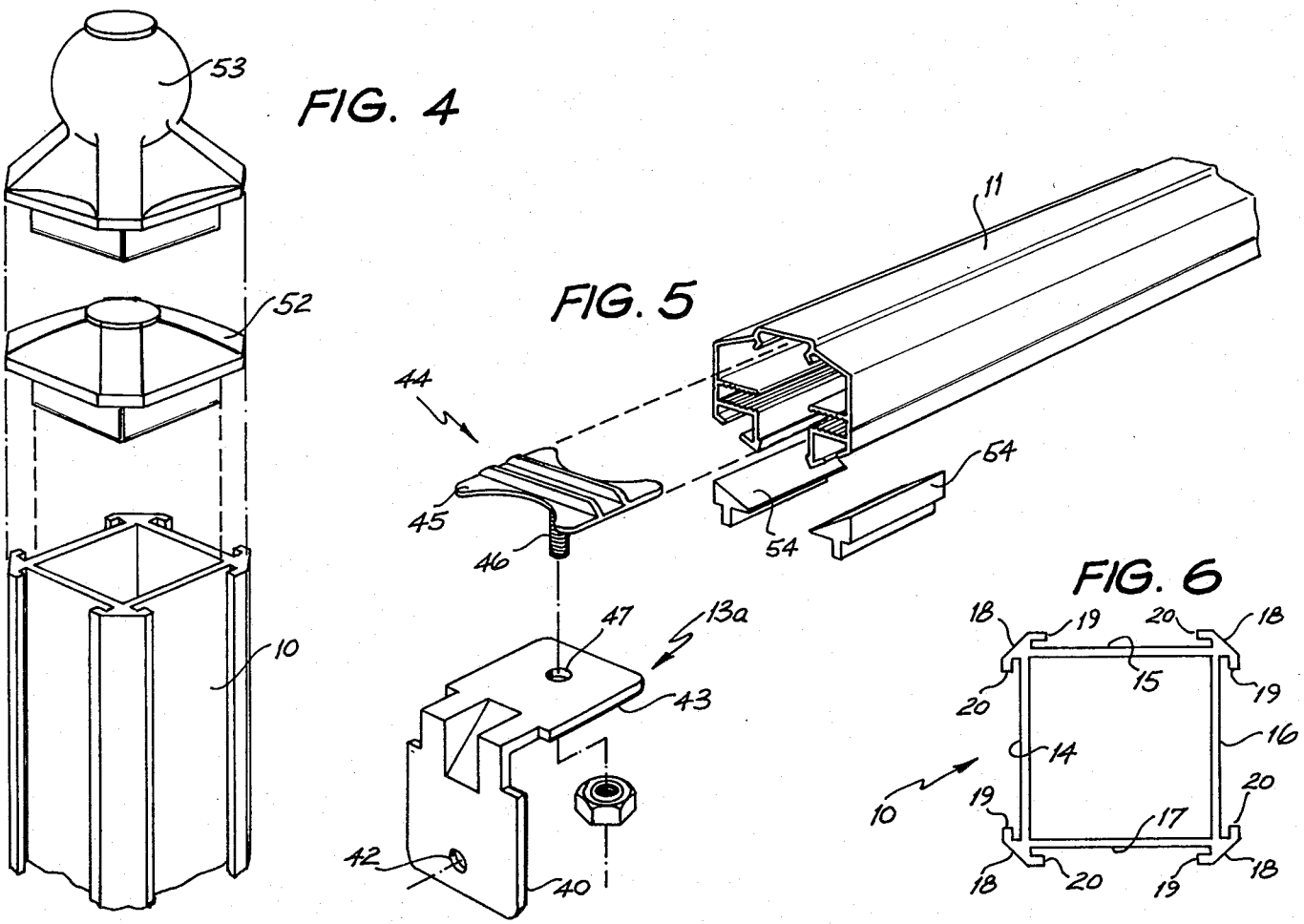
FIG. 4 is a perspective view of the post of the fencing structure shown in FIG. 2 showing alternative forms of post caps.
FIG. 5 is a view similar to FIG. 3 but showing an alternative form of bracket.
FIG. 6 is a cross-sectional view of the post shown in FIG. 4.

The post member 10 is, in this instance, a tubular aluminium extrusion of square cross-section but, of course, other cross-sections may be used. As can be seen in FIG. 6, the post member 10 has four faces 14, 15, 16 and 17 and at each corner there is an external bead 18 having flanges 19, 20. Each face of the post thus has a vertically extending channel that is defined by the face (14, 15, 16 or 17) and the two flanges 20 and 19.

The top rail 11 (which is best seen in FIGS. 2, 3 and 5) is of inverted channel form and has a panel-receiving crown 21 bounded by curved flanges 22. Adjacent the open mouth of the channel there are inwardly directed webs 23, 24 which are spaced apart to define a panel-receiving throat 25 that extends along the length of the rail 11. Depending downwardly from the inner end of the webs 23, 24 are flanges 26, 27 which have opposed beads 28, 29 adapted to grip the panel 12 therebetween. The lower ends of the flanges 26, 27 have outwardly turned flanges 30, 31 which together with the inwardly turned flanges 32, 33 of the rail 11 provide a means for supporting a glazing or decorative panel (not shown) that may cover the panel 12 if required. Overlying the webs 23, 24 are second webs 34, 35 and the opposed faces of each pair of webs 23, 34 and 24, 35 are serrated or grooved.

The rails may be secured to the posts by a pivotting bracket 13 as shown in FIG. 3 or by a fixed bracket **13*a* as shown in FIG. 5. The pivotting bracket 13 is particularly useful for supporting a panel in the form of a gate. Both brackets 13, 13*a* have a first flange 40 which is located in the channel that is defind by the flanges 20, 19 and a face 14, 15, 16 or 17 of the post member 10. The flange 40 is placed at the required position in the channel of the post and then fixed thereto by a fastener 41 such as a self-tapping screw which passes through aperture 42**.

Both brackets **13, 13*a* have a second flange 43 which is located between the web pairs 23, 34 and 24, 35. The second flange 43 is secured to the rail by means of a clamp 44 (see FIG. 5) which has web engaging extensions 45 that sits on top of webs 34, 35 and a threaded stem 46 which passes through the aperture 47 in the flange 43 and the throat 25. A washer and nut is placed on the threaded stem 46 beneath the second flange 43 to clamp the upper face of the flange 43 against the grooves in the webs 34, 35**.

The brackets 13 in FIG. 3 have a collar 48 on the first flange 40 in which is journalled a peg 49 secured to the second flange 43. An end cap 50 closes off the end of rail 11 above the bracket 13 (see FIG. 1). Fastening means 51 may be provided to fix the panel 12 to the top rail 11. As indicated in FIG. 3, the fastening means may be threaded so as to engage the serrations in the opposed faces of the web pairs 23, 34 and 24, 35.

As indicated above, the bottom rail means may be substantially similar to the top rail 11 except that it is inverted. Preferably, the bottom rail means is formed from two bottom rail members 60 one of which is shown in cross-section in FIG. 8. The bottom rail member 60 has web 61, 62 which together with the corresponding webs of an opposed bottom rail member 60 define a panel-receiving throat that extends along the bottom rail means. At the top of the bottom rail member 60 there is a return flange 63 adapted to engage the panel 12. At the bottom of the bottom rail member 60 there is a panel receiving flange 64.

The opposed faces of the webs 61, 62 are serrated to provide a threaded receptacle for fastening means similar to screws 51. When two bottom rail members 60 are placed face to face they form a bottom rail substantially similar to the top rail 11 and a bracket 13 and **13*a* is secured thereto by inserting the second flange 43 of the bracket between the webs 61, 62 of the two rails 60**.

Figure 7:
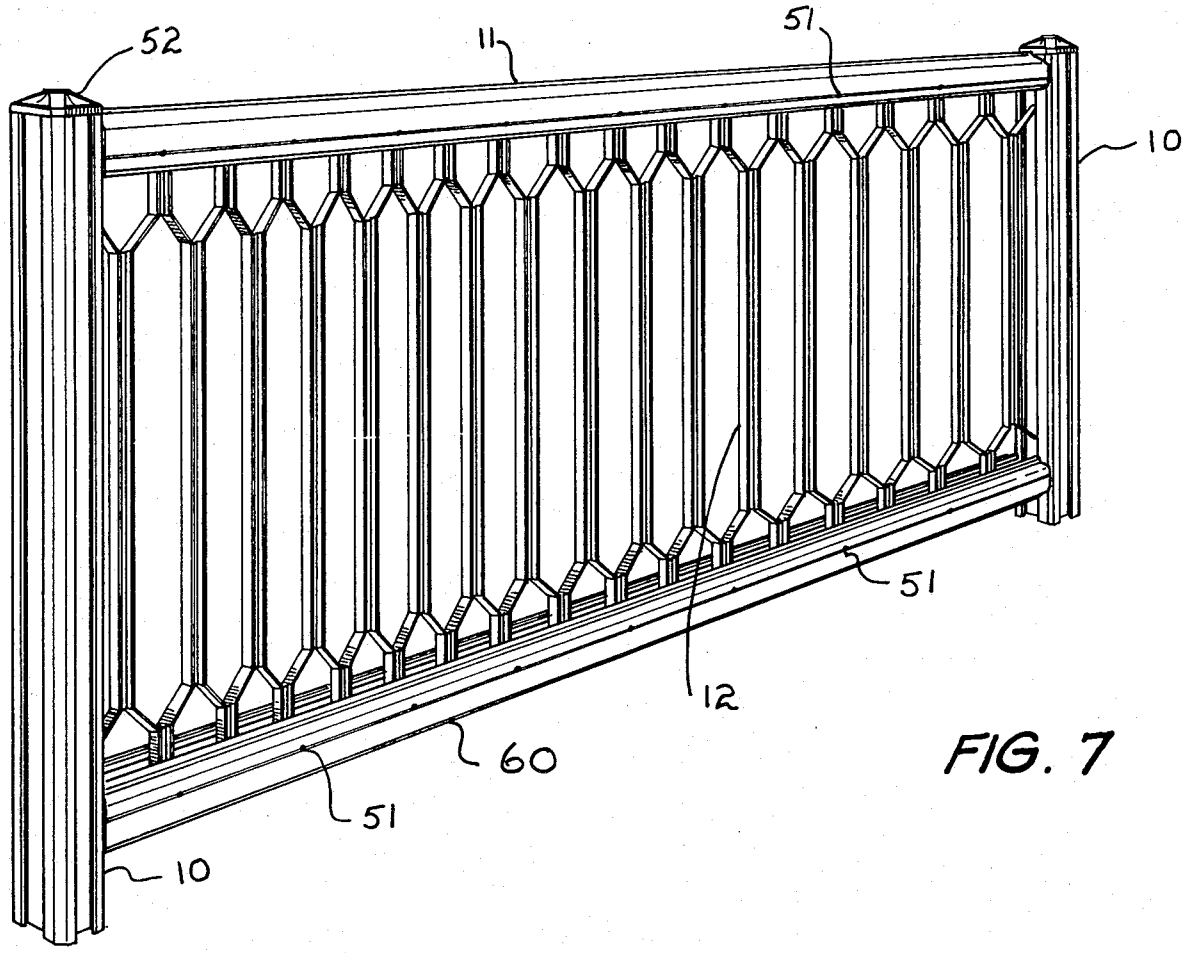
FIG. 7 is a perspective view similar to FIG. 1 showing a single panel fencing structure, and, FIG. 8 is a cross-sectional view of one half of a bottom rail means for the fencing structure shown in FIG. 7
Figure 8:
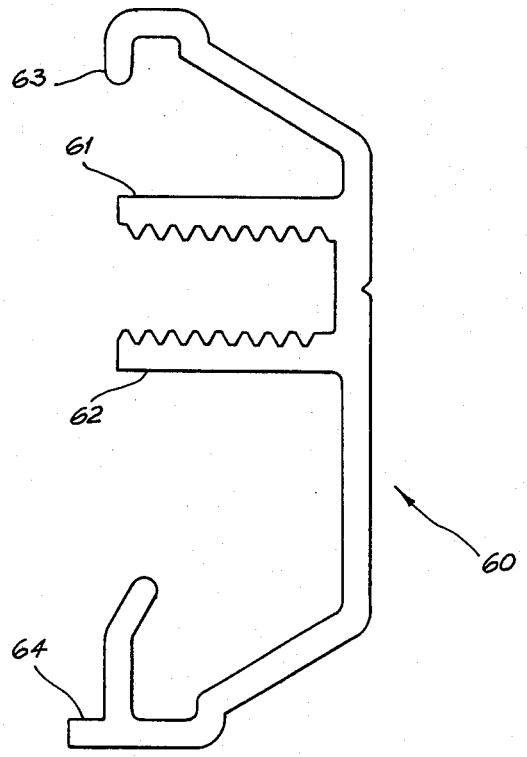

The top of the post 10 may be closed by a cap alternative forms of which are shown in FIG. 2 by numerals 52 and 53. As indicated in FIG. 7, the rails may be aligned with the posts 10 and if the top rail 11 extends over a post inserts 54 are placed in the channels 20, 19, 15 and 20, 19, 17. Alternatively, the rails may be mounted in an outrigger fashion by mounting a bracket in a side channel on post 10.

The open-work panel 12 may be formed by slotting an aluminium extrusion having a repeating pattern of webs and ribs and then stretching the slotted extrusion to open up the slots to provide the panel shown in the drawings.

Various modifications may be made in details of design and construction without departing from the scope and ambition of the invention.

We claim:

1. A fencing or like structure comprising:

(i) a pair of spaced apart upright post members each having vertically extending channel means with the channel means of each post facing one another, (ii) a top rail of inverted channel form extending between the post members and having a pair of opposed, inwardly directed webs defining therebetween a panel-receiving throat that extends along the rail, (iii) bottom rail means extending between the post members and having a panel-receiving throat that extends along the bottom rail means, (iv) a rectangular panel extending between and secured to the top rail and the bottom rail means with the top edge of the panel in the throat of the top rail and its bottom edge in the throat of the bottom rail means, (v) means for securing the end of the top rail to the respective post members, said securing means including:

(a) a bracket having a first flange located in the channel means of the post member and a second flange located in the end of the rail, (b) means for fixing the first flange to the post member, and, (c) means for securing the second flange to the inwardly directed webs of the rail, wherein the top rail has a panel-receiving crown bounded by interior flanges that engage the top edge of the panel, and (vi) third flanges adapted to engage the panel therebetween and extending to a point below said inwardly directed webs.

2. A fencing structure as claimed in claim 1 wherein the bottom rail means comprises a pair of opposed rail members each of which has an inwardly directed web defining therebetween the panel-receiving throat.

3. A fencing structure according to claim 2 and including means for securing the end of the bottom rail means to the respective post members, said bottom rail means securing means including:

(a) a bracket having a first flange located in the channel means of the post member and a second flange located in the end of the bottom rail members, (b) means for fixing the first flange to the post member, and, (c) means for securing the second flange to the inwardly turned webs of the bottom rail members.

4. A fencing structure according to claim 1 and further including a second pair of opposed inwardly directed webs which overlie the said pair of webs.

5. A fencing structure according to claim 4 wherein the opposed faces of the said and second pairs of webs are serrated or grooved.

6. A fencing structure according to claim 2 wherein each bottom rail member has a panel-receiving flange upon which the bottom edge of the panel rests.

7. A fencing structure according to claim 2 wherein the opposed bottom rail members each has a second inwardly directed web which overlies the said web.

8. A fencing structure according to claim 7 wherein the opposed faces of the said and second webs are serrated or grooved.

9. A fencing structure according to claim 1 wherein the panel is an open panel formed by slotting and stretching an extruded section.

10. The fencing structure of claim 1, including:

outwardly turned flanges at lower ends of said third flanges; and inwardly turned flanges on a bottom edge of said inverted channel and facing said outwardly turned flanges, whereby a second panel may be held between said facing outwardly turned flanges and third flanges.

11. The fencing structure of claim 1 wherein said crown is at a top of said channel and said inwardly directed webs are adjacent a bottom of said channel, and wherein said third flanges extend to below said bottom of said channel.

12. The fencing structure of claim 4 wherein said means for securing comprises a clamp securing said second flange to said second pair of webs.

* * * * *